US010384140B2

(12) United States Patent
Lee

(10) Patent No.: US 10,384,140 B2
(45) Date of Patent: Aug. 20, 2019

(54) WALL-CLIMBING TOY

(71) Applicant: MP Development Limited, Hong Kong (CN)

(72) Inventor: Kung Jui Lee, Hong Kong (CN)

(73) Assignee: Poly Rich Industrial Limited, Kowloon (HK)

( * ) Notice: Subject to any disclaimer, the term of this patent is extended or adjusted under 35 U.S.C. 154(b) by 0 days.

(21) Appl. No.: 15/947,945

(22) Filed: Apr. 9, 2018

(65) Prior Publication Data

US 2018/0290065 A1 Oct. 11, 2018

(30) Foreign Application Priority Data

Apr. 11, 2017 (HK) ..... 17103693
Mar. 23, 2018 (HK) ..... 18104048

(51) Int. Cl.
*A63H 11/00* (2006.01)
*A63H 11/04* (2006.01)
*A63H 17/26* (2006.01)

(52) U.S. Cl.
CPC ..... *A63H 11/04* (2013.01); *A63H 17/262* (2013.01)

(58) Field of Classification Search
CPC ..... A63H 11/04; A63H 15/00; A63H 17/262
USPC ..... 446/177, 330, 431, 279
See application file for complete search history.

(56) References Cited

U.S. PATENT DOCUMENTS 1,187,660 A * 6/1916 Savage ..... A63H 29/04 446/289
2,618,889 A * 11/1952 Wigal ..... A63H 11/04 446/133
2,728,168 A * 12/1955 Gier ..... A63H 11/205 446/177
3,061,972 A * 11/1962 Wigal ..... A63H 17/004 446/177
3,638,354 A * 2/1972 Morrison ..... A63H 15/00 446/177
3,810,515 A * 5/1974 Ingro ..... A63H 11/04 180/164
4,087,931 A * 5/1978 Maurer ..... A63H 7/04 446/280

(Continued)

FOREIGN PATENT DOCUMENTS

CN 200966921 Y 10/2007
CN 201727957 U 2/2011

(Continued)

OTHER PUBLICATIONS

Hong Kong Search Report of HK priority application HK18104048.4, dated Apr. 13, 2018.

*Primary Examiner* — Alexander R Niconovich
(74) *Attorney, Agent, or Firm* — Leydig, Voit & Mayer

(57) ABSTRACT

A wall-climbing toy for negotiating an upstanding surface includes a housing with a movable part connected to the housing, wherein the housing has an opening; a wall-climbing wheel assembly located within the housing and partly exposed through the opening to engage an upstanding wall for countering gravitational force; and a transmission system that harvests power in the movement of the housing to bring about movement of the movable part, wherein the transmission system includes a clutch mechanism which engages to move the movable part by or with movement of the housing, and disengages to release the movable part.

15 Claims, 4 Drawing Sheets

(56) References Cited

U.S. PATENT DOCUMENTS 4,258,500 A * 3/1981 Anderson ..... A63H 13/04 446/177
4,333,259 A * 6/1982 Pin-Huang ..... A63H 11/04 180/901
4,477,998 A * 10/1984 You ..... A63H 11/04 446/177
4,764,148 A * 8/1988 Wong ..... A63H 15/00 446/289
4,878,875 A * 11/1989 Pin-Hung ..... A63H 11/04 446/356
4,971,591 A * 11/1990 Raviv ..... A63H 17/26 180/164
5,306,199 A * 4/1994 Locricchio ..... A63H 7/00 446/177
5,498,193 A * 3/1996 Locricchio ..... A63H 7/00 446/361
5,746,641 A * 5/1998 Wong ..... A63H 17/004 446/431
5,755,610 A * 5/1998 Lin ..... A63H 29/02 40/415
5,916,008 A * 6/1999 Wong ..... A63H 17/262 446/431
6,036,572 A * 3/2000 Sze ..... A63H 3/36 446/177
6,793,026 B1 * 9/2004 De Fazio ..... A63H 11/04 180/8.3
7,823,845 B2 * 11/2010 Fontana ..... A63B 27/00 248/200.1
8,371,898 B1 * 2/2013 Sinisi ..... A63H 11/18 180/164
2005/0009442 A1 * 1/2005 Chen ..... A63H 15/00 446/269
2007/0161323 A1 * 7/2007 Fischer ..... A63H 11/04 446/330
2008/0064294 A1 * 3/2008 Wong ..... A63H 11/04 446/441

FOREIGN PATENT DOCUMENTS

CN 202822771 U 3/2013
CN 205494964 U 8/2016
CN 205627057 U 10/2016
CN 205867566 U 1/2017

* cited by examiner

WALL-CLIMBING TOY

The present invention relates to a toy capable of climbing a wall for example particularly, but not exclusively, a toy with parts movable by or with the movement of the toy over the wall.

BACKGROUND OF THE INVENTION

Wall climbing toy in the form of a car is available. Amongst toddlers, toy cars are usually targeted at boys rather than girls. It may be understood as a gender specific toy which is traditionally more often being offered to boys.

The fun factor of a wall climbing car is restricted to the up and down movement of the car over a substantially vertical surface. There is a fine balance between the size of the wall climbing element and the overall weight of the car to meet safety requirements. If the car falls off, it becomes a hazard. However if the wall climbing element overperforms, the car will not travel along the vertical surface. The wall climbing element usually takes up most of the internal space of the toy and becomes the main part of the internal construction that contributes to the overall weight of the car. The spatial restriction prevents the wall climbing toy from developing further and remains gender specific.

The invention seeks to eliminate or at least to mitigate such shortcomings for more fun by providing a new or otherwise improved wall climbing toy.

SUMMARY OF THE INVENTION

According to the invention, there is provided a wall-climbing toy for negotiating an upstanding surface comprising a housing with a movable part connected thereto and having an opening; a wall-climbing wheel assembly provided with the housing and being partly exposed through the opening to engage an upstanding wall for countering an acting gravitational force; and a transmission system that harvests power in the movement of the housing to bring about movement of the movable part; wherein the transmission system includes a clutch mechanism which engages to move the movable part by or with movement of the housing and disengages to release the movable part. Preferably the clutch mechanism includes a pair of cams actable on one another upon engagement to bring about movement of the movable part. More preferably, the transmission system includes a wheel rotatable by or with movement of the housing, it is preferable that one of the cams, a driving cam, is movable by or with the rotation of the wheel while the other of the cams, a driven cam, is provided with the movable part, more preferably the housing is provided with at least two movable parts, the driven cam is positioned on a bridge that joins the two movable parts such that only one driven cam is required to bring about movement of two movable parts.

Advantageously, the movable part(s) is movable in a direction opposite that of the bridge.

More advantageously, the movable part(s) is movable to a default position upon disengagement of the clutch mechanism.

Preferably, the wheel includes a roller and a pair of driving cams which are provided on a periphery of the roller and are spatially separated such that the clutch mechanism is engaged twice in each revolution of the wheel.

More preferably, the movable part(s) is moved to the default position by action of its own weight.

It is preferable that the transmission system transform rotational movement of the wheel to linear movement of the movable parts.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1A:
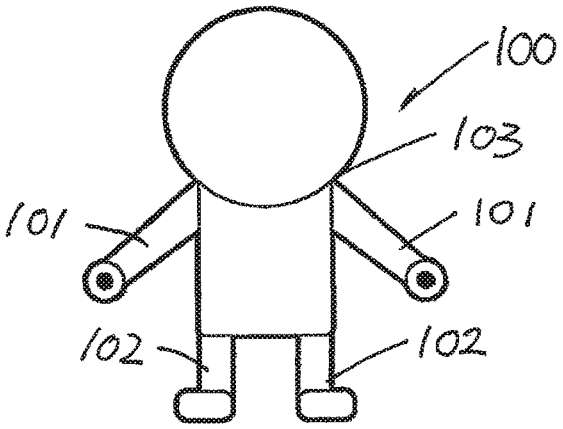
FIG. 1A is a front view of an embodiment of a wall climbing toy in accordance with the invention.
Figure 1B:
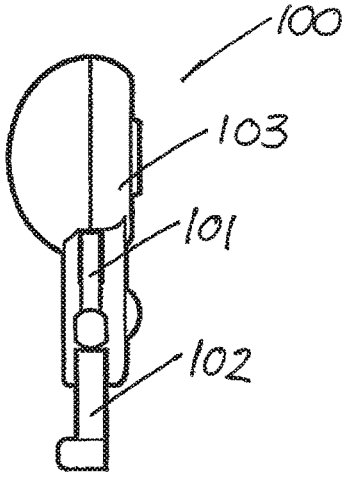
FIG. 1B is a side view of the embodiment in FIG. 1A.
Figure 1C:
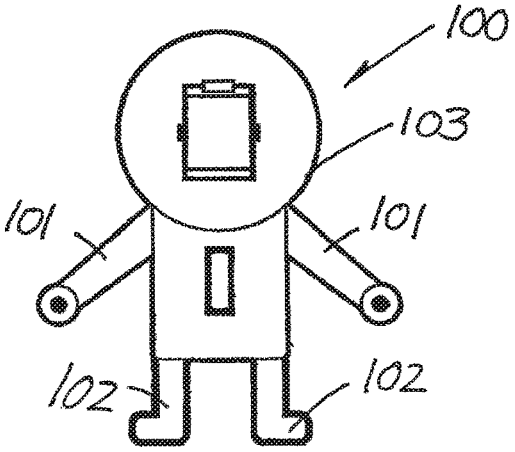
FIG. 1C is a rear view of the embodiment in FIG. 1A.

Referring to FIGS. 1A and 1B there is shown an embodiment of the wall-climbing toy 100 in accordance with the invention. The wall-climbing toy 100 includes a housing 103 that contains a transmission system in connection with movable body parts 101 and 102 to confer an external appearance which resembles that of a figure with movable parts, e.g., a human figure or a spider. The movable body parts may include limbs 101 and 102 that are movable by or with movement of the wall-climbing toy 100 along a wall surface 200. Such movement is made possible by the transmission system provided inside the housing 103. The housing 103 can be of any configuration as long as it defines an interior space sufficient for accommodating the transmission system. The external appearance of the wall-climbing toy 100 could be limitless. The number of movable parts is mainly limited by the size of the transmission system. If the size of the transmission system is a variable, the number of movable parts can again be limitless. That said, the potential of such wall-climbing toy is boundless.

Referring to the specific embodiment as shown in the drawings, a driving mechanism is provided and is at least partly contained in the housing 103. The driving mechanism includes a wall climbing wheel assembly 301 for countering an acting gravitational force. The wheel assembly 301 includes a roller 301A partly coated with an undulated sticky peripheral surface 301B. The roller 301A defines an axis of rotation and is movable between a non-operating position and an operating position. In the non-operating position (FIG. 3A), the wheel 301 is unexposed and in the operating position (FIG. 3B), at least part of the undulated sticky peripheral surface 301B is exposed through an opening 105 of the housing 103 for contacting a wall on which it moves. In more detail, the roller 301A is in connection with a pivotable bracket/cover 104 which can be pivoted between open and closed positions. In its open position, the cover 104 is moved into the housing 103, exposing the wheel 301. At the closed position, the cover 104 is moved out of the housing 103 to conceal the roller 201 and close off the opening 105. Only when the toy 100 is in action will the sticky peripheral surface be exposed. This intends to minimize contact between the sticky peripheral surface and any unwanted matter, e.g., dust that may diminish the wall climbing ability of the wheel assembly 301. In a preferred embodiment where the toy 100 is allowed to move down a wall 200 on its own weight, the wheel 301 functions as a gripping wheel that retains the toy 100 on the wall 200. By manipulating the ratio between the surface area of the undulations that comes into direct contact with the wall 200 and the overall weight of the toy 100, the wheel 301 would amount to a control system in maintaining speed of movement of the toy 100 over the wall 200.

Figure 2:
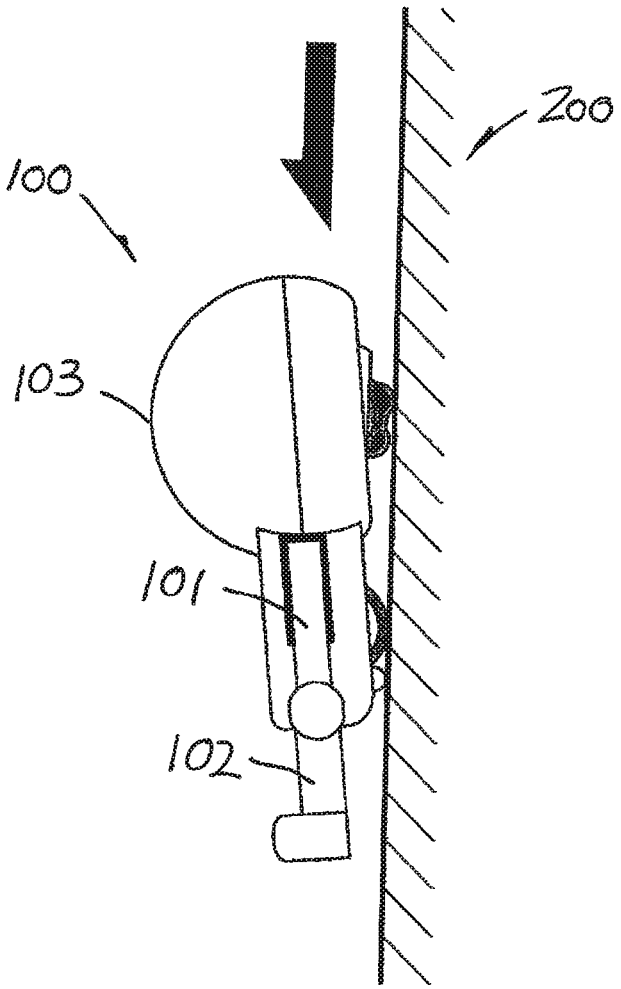
FIG. 2 is an illustrative drawing of the embodiment moving over a substantially vertical wall.
Figure 3A:
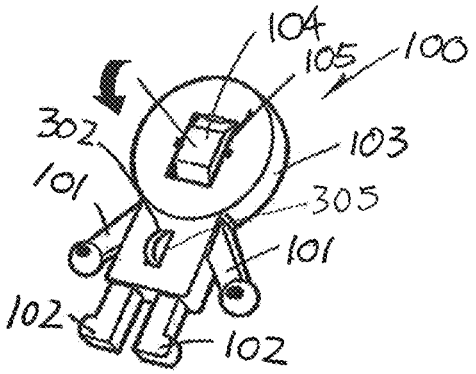
FIG. 3A is a perspective rear view of the embodiment in FIG. 1A at a first state.
Figure 3B:
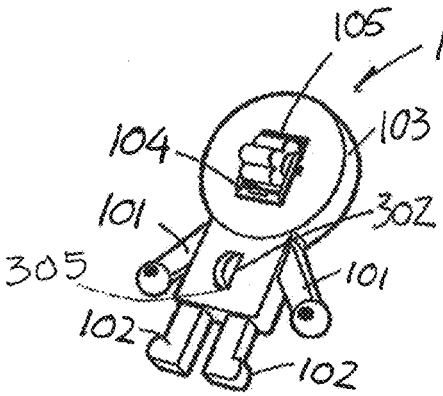
FIG. 3B is a perspective rear view of the embodiment in FIG. 1A at a second state.
Figure 3C:
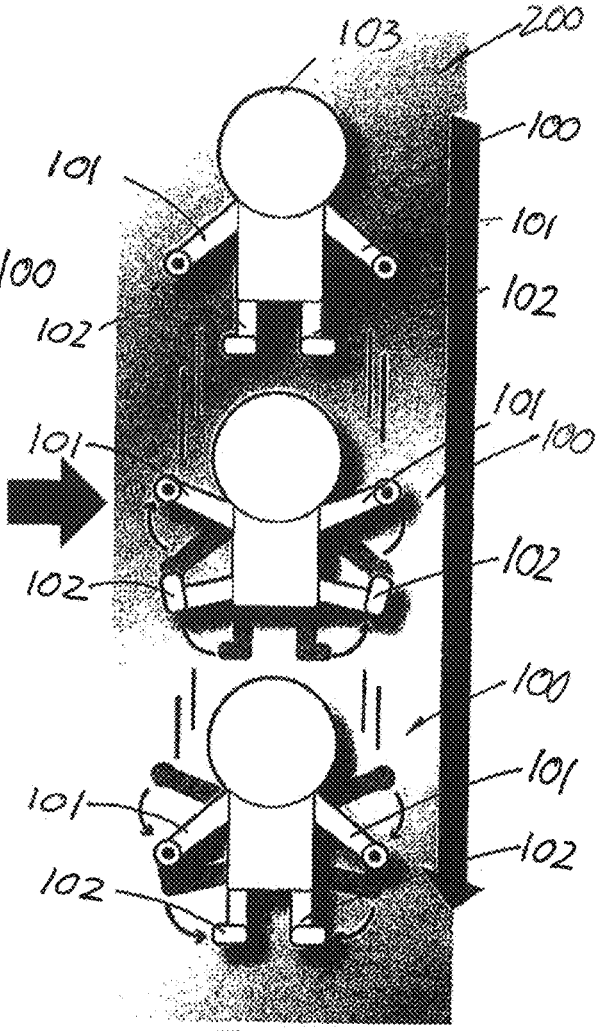
FIG. 3C is a serial drawing showing the embodiment in FIG. 1A moving over a substantially vertical wall with body parts moving therewith.

Within the housing 103, there is provided a transmission system, which is coupled to the driving mechanism. The transmission system includes an auxiliary wheel 302 that projects through an opening 305 in the housing 103 and contacts the wall 200 and is, thereby, movable by the movement of the toy 100 on the wall 200 to bring about movement of the limbs 101 and 102. As shown in FIGS. 2, 3A and 3B, the auxiliary wheel 302 is in alignment with the wall climbing wheel 301 along a longitudinal axis of the housing 103. The rotational axes of wheels 301 and 302 are parallel to one another such that when the toy 100 is placed on an upstanding wall 200, the auxiliary wheel 302 may be understood as the front wheel while the wall climbing wheel 301 may be a rear wheel when the toy 100 descends on the wall. The auxiliary wheel 302 includes a tire 302B that surrounds a rim 3021 of a roller 302A. A respective connector 3022 is provided on each of the two opposite sides of the rim 3021 and the connectors are arranged coaxially, and rotate with the rotation of the auxiliary wheel 302.

The connectors 3022 form an important part of the transmission system as they transform the rotational movement from the auxiliary wheel 302 to a linear repetitive movement of the limbs 101 and 102. More specifically, each connector 3022 has a sleeve that surrounds the roller 302A. On the periphery of the sleeve there is a pair of protrusions 3023 which are spaced apart from and preferably arranged opposite to one another. As the roller 302 rotates, the protrusions 3023 sequentially engage corresponding protrusions 106 extending from the limbs 101 and 102 to bring about their linear movement. The protrusions 3023 and 106 are in the form of cams capable of acting on one another to function as clutches to selectively engage and disengage, thereby bringing about the movement of the limbs 101 and 102 in a preferred direction. The separation or the angular displacement between the two protrusions 3023 on each sleeve governs the rounds of movement of the limbs 101 and 102. The protrusions 3023 and 106 collectively form the clutch system that engages and disengages to bring about movement of the limbs 101 and 102.

The corresponding protrusions 106 are provided on and extend from respective bridges 107. Each of the bridges 107 is connected to a pair of upper and lower limbs 101 and 102 at opposite ends. Each revolution of the roller 302 brings about sequential engagements of the two protrusions 3023 to the same corresponding protrusion 106. The protrusions 3023 are moved with the roller 302 and, upon engagement with the protrusion 106, exert a directional force on the protrusion 106 to move the bridge 107 in a first direction. The directional force moves the corresponding two limbs 101 and 102 in a second direction opposite to the first direction. As there are two protrusions 3023, the limbs 101 are moved in the second direction twice.

In the preferred embodiment, the figure has two upper limbs 101 and two lower limbs 102. The two pairs of limbs require two bridges 107 one for each pair of upper and lower limbs 101 and 102. On each of the bridges 107 there is a respective protrusion 106. On the roller 302, there are two connectors 3022 each having a sleeve and a pair of protrusions 2023. These connectors 3022 are arranged on opposite sides of the rim 3021. In this embodiment, the separation between the protrusions 3023 is the same in each connector 3022 such that the four limbs 101 and 102 will be moved simultaneously. It is possible for the transmission system to have a non symmetrical arrangement such that the left and right limbs move differently as the toy 100 climbs down a wall.

As the roller 302A turns, the connectors 3022 turn with it. The protrusions 2023 of each connector 3022 sequentially engages the respective protrusion 106 on respective bridge 107 to move the bridge 107 in a first direction that, in turn, brings about movement of the limbs 101 and 102 in a second direction. The limbs 101 and 102 return to their default positions on their own weight and will be moved in the second direction again when the latter of the two protrusions 2023 engages the protrusion 106.

Figure 4:
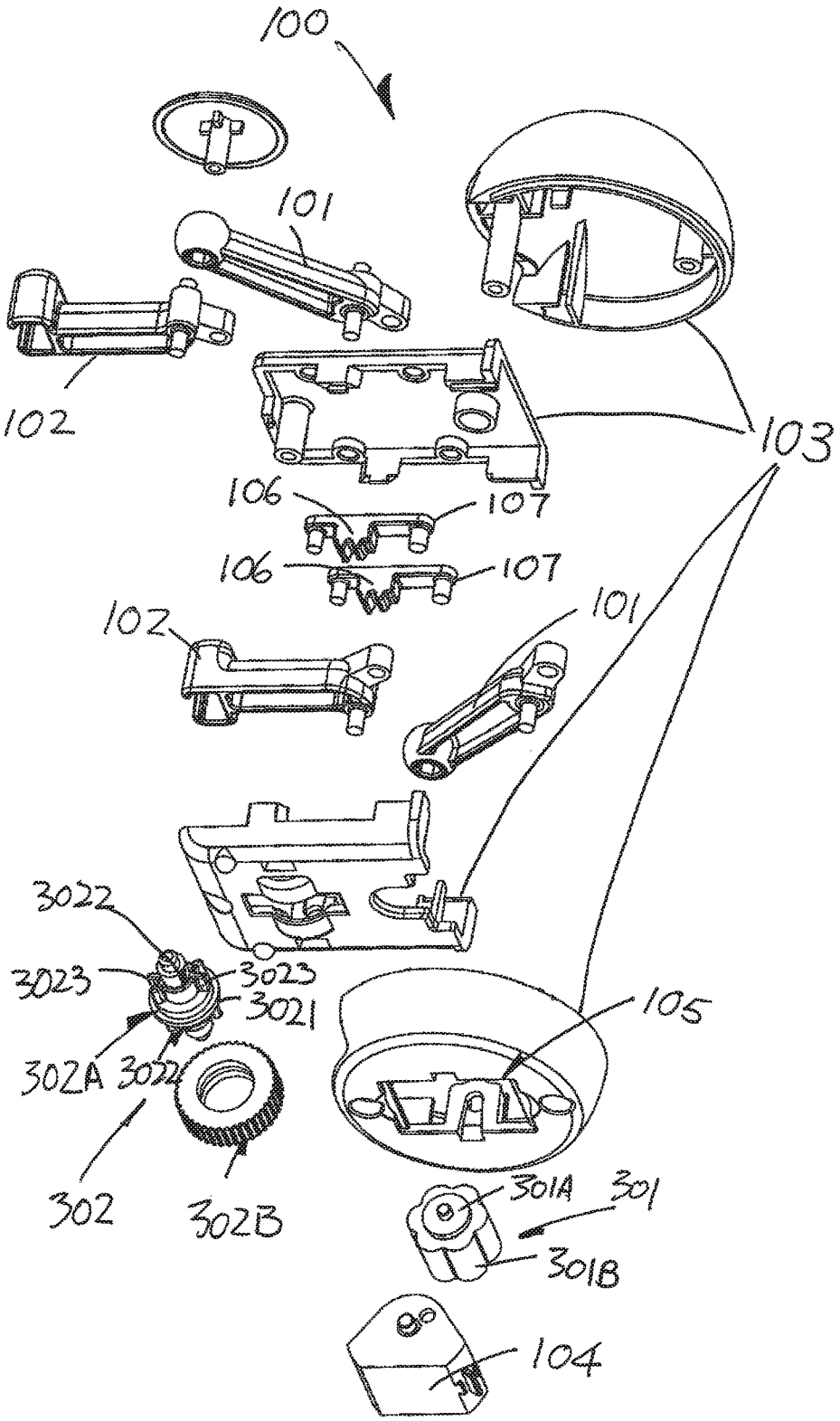
FIG. 4 is an exploded view of the embodiment in FIG. 1A.

As shown in FIG. 4, the four limbs 101 and 102 are pivotally connected to the bridges 107 and to the housing 103, but the bridges 107 are not directly connected to the housing 103.

The number of limbs 101 and 102 connectable to the bridge 107 depends on the relative sizes of the limbs. In other words, the transmission system may be readily modified to accommodate more moving parts to be moved by or with movement of the auxiliary wheel 302.

The auxiliary wheel 302 also functions as a stabilizing wheel as the toy 100 moves down the wall 200. Careful calculation is required to maintain the toy 100 on the wall 200 yet permitting the toy 100 to move thereon in a controlled speed. It relies on the overall friction between the wheels 301 and 302 and the wall 200. The amount of friction required is dependent on the collective surface area on the wheels that is in engagement with the wall 200 at a specific time vs the weight of the toy 100.

The invention has been given by way of example only, and various other modifications of and/or alterations to the described embodiment may be made by persons skilled in the art without departing from the scope of the invention as specified in the appended claims.

The invention claimed is:

1. A wall-climbing toy for negotiating an upstanding surface, the wall-climbing toy comprising:

a housing with a movable part located partially within the housing, pivotally connected to the housing and protruding from the housing, wherein the housing has an opening;

a wall-climbing wheel assembly located within the housing and partly exposed through the opening to engage an upstanding wall for countering gravitational force on the wall-climbing toy; and a transmission system that harvests power from movement of the housing on the upstanding wall to bring about movement of the movable part, wherein the transmission system includes a clutch mechanism engaging and moving the movable part upon movement of the housing on the upstanding wall, and disengaging and releasing the movable part upon further movement of the housing on the upstanding wall, the clutch mechanism including a driven cam coupled to the movable part, and a driving cam, and a driven wheel that is rotated by movement of the housing on the upstanding wall, the driven wheel including a connector that rotates with rotation of the driven wheel, and the connector connects the driven wheel to the clutch mechanism, the driving cam moves upon rotation of the connector, and the driving cam and the driven cam are selectively engaged upon rotation of the driven wheel and produce, when engaged, movement of the movable part in response to rotation of the driven wheel.

2. The wall-climbing toy as claimed in claim 1, including two movable parts, and a bridge to which the two movable parts are respectively pivotally connected, wherein the driven cam is positioned on the bridge such that the driven cam moves both of the two movable parts when the driving cam engages and moves the driven cam.

3. The wall-climbing toy as claimed in claim 2, wherein the two movable parts are movable in a direction opposite direction of movement of the bridge.

4. The wall-climbing toy as claimed in claim 3, wherein the two movable parts move to a default position upon disengagement of the clutch mechanism.

5. The wall-climbing toy as claimed in claim 4, wherein the two movable parts move to the default position by weight of the movable parts.

6. The wall-climbing toy as claimed in claim 1, wherein the driving cam is located on the connector and the driven cam is coupled to the movable part.

7. The wall-climbing toy as claimed in claim 1, wherein the connector is a roller located in the driven wheel.

8. The wall-climbing toy as claimed in claim 7, wherein the driven cam is located on a periphery of the roller.

9. The wall-climbing toy as claimed in claim 7, wherein the driven wheel includes a tire that surrounds the roller.

10. The wall-climbing toy as claimed in claim 7, including two driven cams located at respective, spaced-apart positions on a periphery of the roller so that the clutch mechanism is engaged twice during respective parts of each revolution of the wheel.

11. A wall-climbing toy for descending an upstanding surface, the wall-climbing toy comprising:

a housing having first and second openings;

a movable part located partially within the housing, pivotally connected to the housing, and protruding from the housing;

a wall-engaging wheel assembly located within the housing and including a wall-climbing wheel partially exposed from the housing through the first opening for engaging an upstanding wall, rotating with movement of the wall-climbing toy on the upstanding wall, and countering gravitational force on the wall-climbing toy; and a transmission system located within the housing and transmitting energy produced by movement of the wall-climbing toy on the upstanding wall and causing movement of the movable part upon movement of the wall-climbing toy on the upstanding wall, wherein the transmission system includes an auxiliary wheel partially exposed from the housing through the second opening for engaging the upstanding wall and rotating upon movement of the wall-climbing toy on the upstanding wall, a connector extending from and rotating with rotation of the auxiliary wheel, a driving cam on the connector, a bridge located in the housing movable with respect to the housing, and to which the movable part is pivotally connected, and a driven cam on the bridge, wherein the driving cam selectively engages the driven cam when the auxiliary wheel rotates, and moves the moveable part in response to rotation of the auxiliary wheel.

12. The wall-climbing toy as claimed in claim 11, including two movable parts located partially within the housing, respectively pivotally connected to the housing, and protruding from the housing, wherein the two movable parts are respectively pivotally connected to the bridge and the driven cam moves both of the two movable parts when the driving cam engages and moves the driven cam.

13. The wall-climbing toy as claimed in claim 11, wherein the movable part moves to a default position upon disengagement of the driving cam and the driven cam.

14. The wall-climbing toy as claimed claim 13, wherein the movable part moves to the default position by weight of the movable part.

15. The wall-climbing toy as claimed in claim 11, wherein the auxiliary wheel includes a pair of driving cams located at respective, spaced-apart positions on a periphery of the connector so that the driven cam is engaged twice during parts of each revolution of the second roller.

* * * * *